US007678398B2

(12) United States Patent
von der Heide et al.

(10) Patent No.: US 7,678,398 B2
(45) Date of Patent: Mar. 16, 2010

(54) INSERT FOR PRESSURIZED CONTAINERS FOR LIQUIDS, ESPECIALLY BEVERAGE CONTAINERS

(75) Inventors: Stefan von der Heide, Lohne (DE); Martin Presche, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 193 days.

(21) Appl. No.: 11/522,128

(22) Filed: Sep. 15, 2006

(65) Prior Publication Data

US 2007/0009633 A1 Jan. 11, 2007

Related U.S. Application Data

(63) Continuation of application No. 10/104,569, filed on Mar. 21, 2002, now abandoned.

(30) Foreign Application Priority Data

Apr. 19, 2001 (DE) ..... 201 06 836 U

(51) Int. Cl.
*B65D 81/32* (2006.01)

(52) U.S. Cl. ..... 426/112; 426/120; 426/131; 220/506; 220/528; 206/221; 206/217

(58) Field of Classification Search ..... 426/112, 426/115, 120, 131, 394, 397; 220/501, 505, 220/506, 528; 206/217, 219, 221; 43/43.14; 441/1–34

See application file for complete search history.

(56) References Cited

U.S. PATENT DOCUMENTS 2,842,888 A * 7/1958 Landrum ..... 43/44.95
3,094,719 A * 6/1963 Nelson ..... 441/1
3,568,228 A * 3/1971 Rudelick ..... 441/3
5,620,725 A * 4/1997 Jamieson et al. ..... 426/112
5,714,186 A * 2/1998 Nash et al. ..... 426/106
5,780,083 A * 7/1998 Wright et al. ..... 426/112
5,865,308 A * 2/1999 Qin et al. ..... 206/219
6,620,444 B1 * 9/2003 Reichinger ..... 426/115
6,896,920 B1 * 5/2005 Forman et al. ..... 426/106
7,228,789 B1 * 6/2007 Mondszein et al. ..... 99/277
2008/0245801 A1 * 10/2008 Ullmann et al. ..... 220/528

FOREIGN PATENT DOCUMENTS

WO WO 96/24542 * 8/1996
WO WO 96/36545 * 11/1996
WO WO 99/54229 * 10/1999

* cited by examiner

*Primary Examiner*—Drew E Becker
(74) *Attorney, Agent, or Firm*—Friedrich Kueffner

(57) ABSTRACT

An insert for insertion into a pressurized container for liquids has a component chamber for receiving an active substance and a pressure chamber for introducing the active substance into the liquid when opening the container for liquids. The pressure chamber has at least one small outer bore. The insert is freely movable in the container for liquids but has such a stable floating position on a surface of the liquid within the container for the liquids that the outer bore always points upwardly and optimizes a pressure compensation with the environment. After opening the container for liquids, the resulting relative overpressure in the pressure chamber in relation to the released pressure in the container for liquids effects an opening of the component chamber.

10 Claims, 2 Drawing Sheets

Fig. 1
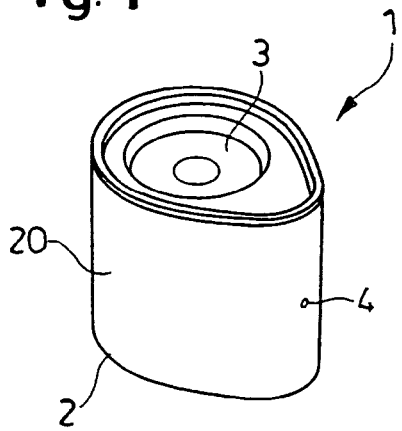
Fig. 2
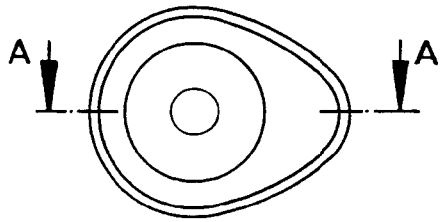
Fig. 1a
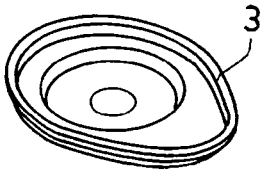
Fig. 3 A-A
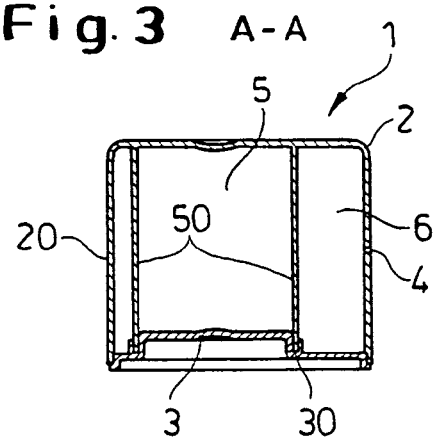
Fig. 1b
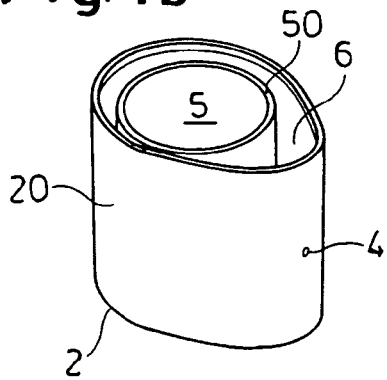

INSERT FOR PRESSURIZED CONTAINERS FOR LIQUIDS, ESPECIALLY BEVERAGE CONTAINERS

The present application is a continuation of application Ser. No. 10/104,569, filed Mar. 21, 2002, now abandoned, the contents of which are incorporated herein by reference.

BACKGROUND OF THE INVENTION

1. Field of the Invention

The invention relates to an insert for pressurized containers for liquids, in particular, beverage containers. The insert comprises a component chamber for receiving a liquid, paste-like, powder-like or solid component, for example, a flavoring agent, coloring agent, or other agents. The insert moreover comprises a pressure chamber as a means for introducing the component into the liquid when opening the container for liquids, wherein the pressure chamber has a small outer bore.

2. Description of the Related Art

The introduction of a component or active substance into a liquid with the goal of changing the properties of this liquid in a certain way is known for different fields of application. In this connection, generally two different applications are to be differentiated, in particular:

- the introduction of the active substance into the liquid already during manufacture of the final product, for example, the introduction of coloring or flavoring agents in the manufacture of beverages such as sodas, liquor, etc.;
- the introduction of the active substance only upon using or consuming the liquid, for example, the introduction of milk and sugar into coffee which has been previously prepared.

For introducing the active substance already during the manufacture of the liquid, known devices, such as, for example, metering pumps or weighing devices, are employed which have to meter correspondingly large quantities depending on the manufacturing process. The introduction of the active substance into the liquid with delay after the production process, wherein the point in time of the introduction of the active substance can be selected freely, presents the difficulty of metering, depending on the amount of liquid, correspondingly small amounts of active substance and of storing the liquid and the active substance separate from one another and of bringing them into contact only as needed.

From European patent document 0 965 536 an insert for receiving a solid, paste-like, or liquid agent, for example, a coloring agent or a flavoring agent, for use in beverage containers is known for the purpose of a metered introduction of this agent into a beverage. The introduction of the active substance is carried out automatically when opening the beverage container which is pressurized by gas pressure. The known active substance container is cylindrical and of a stepped configuration with two chambers and with a dispensing opening. It is connected fixedly to the inner bottom of the beverage container. The configuration and the introduction of the insert or active substance container are relatively complex and cost-intensive, and, moreover, this insert is neither suitable for all types of containers for liquids nor for special applications.

SUMMARY OF THE INVENTION

It is an object of the present invention to provide an insert for pressurized containers for liquids, in particular, beverage containers, with which in a simple way any suitable component or active substance can be introduced into a liquid wherein the introduction is to take place automatically at any desired point in time and then quickly, i.e., without long-term action, and automatically, and wherein storage of the active substance separate from the liquid is not required.

In accordance with the present invention, this is achieved in that the insert is freely movable in the container for liquids but has such a stable floating position on the surface of the liquid within the container for the liquids that the outer bore always points upwardly and, in this way, optimizes a pressure compensation with the environment, wherein, after opening the container for liquids, the then resulting relative overpressure in the pressure chamber in relation to the decreased pressure in the container for liquids effects an opening of the component chamber.

In this way, it is ensured that the insert, after introduction into the container for the liquids and closing the container, the pressure build-up in the pressure chamber of the insert is realized without problems and, when later on opening the container for liquids, the insert also opens without problems and releases the active substance from the component chamber. A separate storage of the active substance is not required because the active substance, spatially still separate from the liquid, is however contained in the same container. Metering is also no problem because the active substance container contains exactly the amount of active substance which is to be introduced.

Applications for the subject matter of the invention are the following:

- syrup to be introduced into beer, for example, top-fermented beer such as "Berliner Weisse"
- vitamin components for juices
- components for long drinks
- cocoa powder for milk
- flavoring agents for milk shakes
- plant fertilizer in liquid
- digestive aid in liquid
- salts of any type in liquid.

Gases which can be used in the form of their gas volume to maintain the required overpressure in the liquid or beverage containers, such as soda or beer containers, as well as during their consumption are preferably carbon dioxide, nitrogen, but also air and all noble gases in any suitable mixing ratio.

For the purpose of simplifying manufacture, it is advantageously provided according to the invention that the insert is comprised of an elongate insert member which is provided with a lid on one side.

Moreover, it is provided that the insert member has an identical cross-section over its length with a median point of the surface area or a median point axis or median point line displaced to one side, wherein the outer bore is arranged at the location which is farthest removed from the median point of the insert member in the outer wall. Moreover, it can be expedient when several outer bores-are provided in the outer wall of the insert member.

Especially expedient is an insert that is droplet-shaped in cross-section. Alternatively, the insert in cross-section may be approximately egg-shaped.

According to a further embodiment of the invention, the component chamber in the insert is cylindrical and completely enclosed by the pressure chamber. Advantageously, the lid for this purpose has an annular groove which is engaged by the end of the wall of the component chamber in the closed state. With this measures, a problem-free assembly of the individual parts as well as a simple and problem-free opening of the component chamber are ensured.

Since the quantity of the active substance to be introduced into the liquid can vary according to the specific need, the size of the component chamber containing the active substance is adjustable.

BRIEF DESCRIPTION OF THE DRAWING

In the drawing:

FIG. 1 is a perspective view of the insert according to the invention;

FIG. 1*a* is a perspective view onto the lid of the insert according to FIG. 1;

FIG. 1*b* is a perspective view of the insert according to FIG. 1 in the open state without lid;

FIG. 2 is a plan view onto the insert according to FIG. 1;

FIG. 3 shows a section along the line A-A of FIG. 2;

DESCRIPTION OF THE PREFERRED EMBODIMENTS

Figure 4:
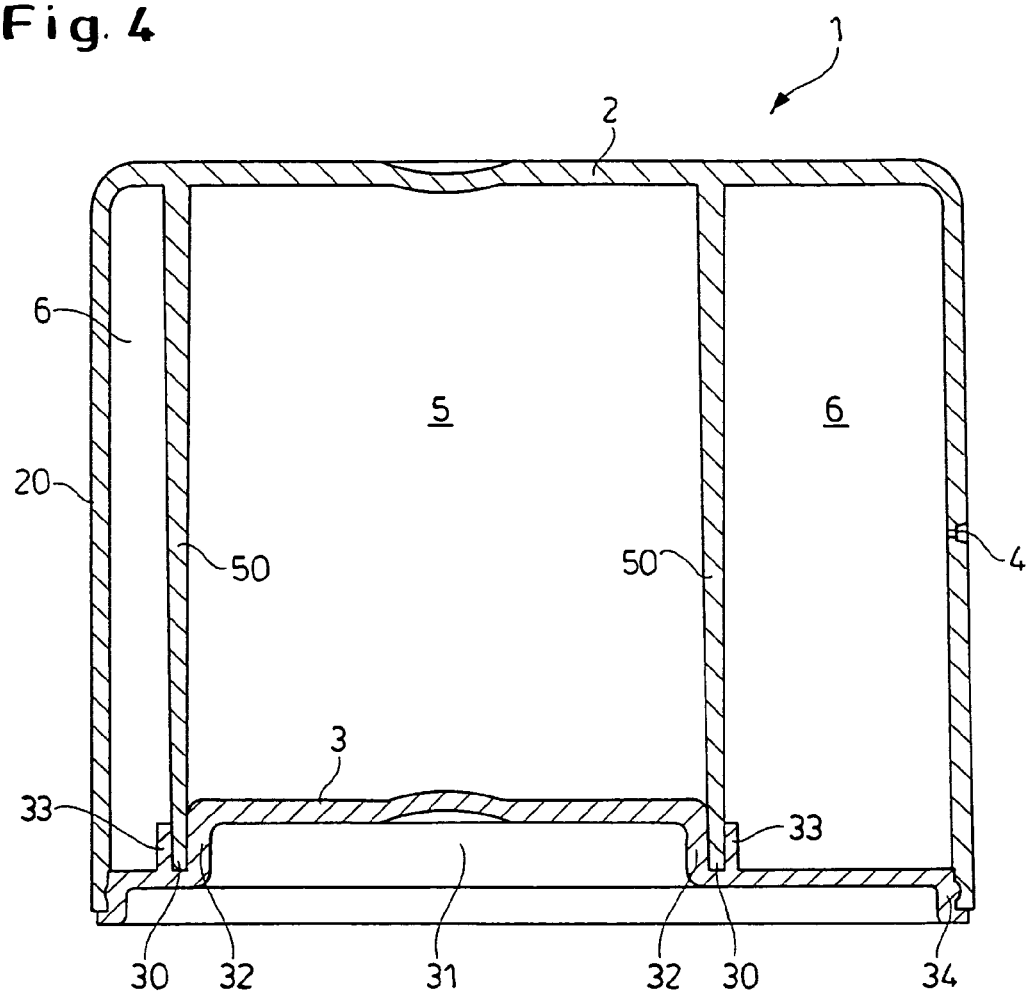
FIG. 4 shows a greatly enlarged illustration of FIG. 3.

In FIGS. 1 through 4 one example of an application of the insert 1 according to the invention for pressurized containers for liquids, preferably beverage containers (not illustrated), is shown. The insert is comprised substantially of an insert member 2 with a lid 3 wherein the insert member 2 is provided in its outer wall 20 with an outer bore 4.

According to FIGS. 1*b*, 3, and 4, the insert member 2 has a component chamber 5 for receiving an active substance in the form of a component that is liquid, paste-like, powder-like or solid, for example, a flavoring agent, coloring agent, or other active substance; moreover, a pressure chamber 6 is provided as a means for introducing the component into the liquid when opening the liquid container and the lid 3 is separated from the insert member 2.

The component chamber 5 in the insert 1 is cylindrical and surrounded by the pressure chamber 6, separated by the partition 50. Especially expediently, the lid 3 has an annular groove 30 which is engaged by one end of the wall 50 of the component chamber 5 in the closed state. The annular groove 30 is arranged between the sidewall 32 of a circular recess 31 and an outer annular collar 33 so that a canting-free blast-off of the lid 3 is ensured. For a simple and safe assembly, the lid 3 can be snapped into place with its periphery 34 into the outer wall 20 of the insert member 2.

The elongate insert member 2 illustrated in the Figures is shown to have identical cross-section over its length and has a median point of the surface area (cross-section) or median point axis or line moved to one side (see particularly FIG. 2) wherein the outer bore 4 is arranged at a location of its outer wall 20 which is farthest removed from the median point of the insert member 2.

The insert 1 with the component or active substance is introduced into the beverage container, for example, a soda or beer can or bottle. Since the insert 1 floats and is configured such that the small outer bore 4 always points upwardly, and is thus positioned in the area where the $CO_2$ collects, pressure compensation is enabled via the small bore 4 after closing the container. When the beverage container is opened, resulting in a sudden inner pressure loss, a pressure compensation of the gases in the pressure chamber 6 still under overpressure cannot be realized only via the small bore 4 in a short period of time. The result is that by means of the still present gas pressure relative to the now pressure-relieved surroundings, the lid 3 is blasted off and the component chamber 5 opens. In this way, the active substance or component, in the form of a liquid, a powder, a paste or a solid, to be mixed with the liquid is introduced into the liquid surrounding the insert 1. By shaking the container, an even more intensive mixing of the liquid with the active substance is possible so that in a very short period of time the desired final product is obtained.

By using the insert 1 according to the invention, a possibility is provided to store a liquid together with an active substance required for the end use or with one or several desired components with the advantage that the metering step is carried out automatically when opening the beverage container. Moreover, errors due to wrongly metered quantities or as a result of a premature metering before the end use can no longer occur.

The features and configurations according to the invention are not limited to the embodiment illustrated in the drawings. Possible variations of the insert 1 according to the invention for containers for liquids can reside in that, for example, the insert 1 and/or the chambers 5, 6 arranged therein have different suitable cross-sectional shapes and that, for example, several separate component (5) and/or pressure chambers 6 are provided adjacent to one another with different opening features. The respective constructive configuration is left up to a person skilled in the art.

While specific embodiments of the invention have been shown and described in detail to illustrate the inventive principles, it will be understood that the invention may be embodied otherwise without departing from such principles.

What is claimed is:

1. An insert for insertion into a container for liquids under pressure, which insert is freely movable in the container, the insert comprising an insert member having an outer wall, the insert member defining a component chamber for receiving an active substance, a pressure chamber for effecting an introduction of the active substance into the liquid when the container is opened, wherein a pressure of the pressure chamber is in an equilibrium with the pressure of the container through at least one small outer bore in the pressure chamber, the insert which is freely moveable within the container on a surface of the liquid assumes a stable floating position, so that the outer bore is always located above the liquid level and causes an optimized pressure equalization of the pressure chamber and the pressure of the container, wherein the insert member has an asymmetrical center of gravity and a drop-shaped or egg-shaped cross-section along an entire longitudinal axis of the insert member from a lid to an opposing outer wall so as to produce an asymmetrical center of gravity which creates the stable floating position, perpendicular to the longitudinal axis the insert member has a rectangular cross-section, a lid simultaneously closes the pressure chamber and the component chamber, and in the stable floating position of the insert makes possible a horizontal discharge of the components into the liquid, wherein the component chamber is cylindrical and arranged parallel to the longitudinal axis of the insert member so as to sustain the asymmetrical center of gravity of the insert member, wherein the outer bore is located in the outer wall at a position farthest removed from the center of gravity of an area of the drop-shaped or egg-shaped cross-section.

2. The insert according to claim 1, wherein the insert member is elongate, and the lid is provided on one side of the insert member so as to close in common the component chamber and the pressure chamber.

3. The insert according to claim 2, wherein the lid has an annular groove in which an end of a wall of the component chamber engages in a closed state.

4. The insert according to claim 3, wherein the lid has a circular recess and a sidewall surrounding the recess, wherein the lid has an outer annular collar surrounding the sidewall and wherein the annular groove is located between the sidewall and the outer annular collar.

5. The insert according to claim 2, wherein the lid has a periphery snapped into place on the outer wall of the insert member.

6. The insert according to claim 1, wherein a plurality of the outer bores are provided in the outer wall.

7. The insert according to claim 1, wherein the component chamber is cylindrical and completely surrounded by the pressure chamber.

8. The insert according to claim 1, wherein the container for liquids is a beverage container.

9. The insert according to claim 1, wherein the active substance is a paste, a solid, a liquid or a powder.

10. The insert according to claim 1, wherein the active substance is a flavoring agent or a coloring agent.

* * * * *